US007661675B2

(12) United States Patent
Lan et al.

(10) Patent No.: US 7,661,675 B2
(45) Date of Patent: Feb. 16, 2010

(54) AUTOMATIC DOCUMENT FEEDER

(75) Inventors: Chia-Tsui Lan, Taipei (TW); Ching-Tse Wang, Taipei (TW); Teng-Kuang Lee, Taipei (TW)

(73) Assignee: Primax Electronics Ltd., Taipei (TW)

( * ) Notice: Subject to any disclaimer, the term of this patent is extended or adjusted under 35 U.S.C. 154(b) by 10 days.

(21) Appl. No.: 11/748,040

(22) Filed: May 14, 2007

(65) Prior Publication Data

US 2008/0191403 A1 Aug. 14, 2008

(30) Foreign Application Priority Data

Feb. 9, 2007 (TW) ..... 96104719 A

(51) Int. Cl.
*G03G 15/00* (2006.01)

(52) U.S. Cl. ..... 271/275; 271/4.06; 271/4.09; 399/367

(58) Field of Classification Search ..... 271/4.06, 271/4.09, 10.07, 10.1, 225, 275; 399/367
See application file for complete search history.

(56) References Cited

U.S. PATENT DOCUMENTS 3,747,918 A * 7/1973 Margulis et al. ..... 271/4.03
4,171,129 A * 10/1979 Daley et al. ..... 271/6
4,896,876 A * 1/1990 Yamada et al. ..... 271/258.03
5,119,145 A * 6/1992 Honjo et al. ..... 399/371
5,132,741 A * 7/1992 Kitajima et al. ..... 399/370
5,223,905 A * 6/1993 Yamada et al. ..... 399/370
5,365,323 A * 11/1994 Ando ..... 399/367
6,650,854 B2 * 11/2003 Sone ..... 399/211
2004/0113352 A1 * 6/2004 Chiang ..... 271/109

FOREIGN PATENT DOCUMENTS

JP 58152737 A * 9/1983

* cited by examiner

*Primary Examiner*—Patrick H Mackey
*Assistant Examiner*—Jeremy Severson
(74) *Attorney, Agent, or Firm*—Kirton & McConkie; Evan R. Witt

(57) ABSTRACT

The present invention provides an automatic document feeder comprising a pick up roller module, a drive roller module, an ejecting idle roller module and a main belt. A main driving roller of the driving roller module drives the main belt to transport the document, and the main belt encircles the main driving roller and a first ejecting idle roller of the ejecting idle roller module.

4 Claims, 2 Drawing Sheets

AUTOMATIC DOCUMENT FEEDER

FIELD OF THE INVENTION

The present invention relates to an automatic document feeder, and more particularly to an automatic document feeder cooperating with a scanner.

BACKGROUND OF THE INVENTION

With the rapid development of microelectronic technology and the process technology, the computer and peripheral equipments are getting more and more popular in the enterprises and families, wherein the input and out devices of the peripheral equipments are frequently being used to fit the current multimedia trend. Besides, in the present age of digitization, the scanner is a popular input device used to convert the analog information recorded on a sheet or paper into digital format for conveniently storing in a computer.

Referring to FIG. 1, which is a schematic view showing the structure of a conventional automatic document feeder (ADF). The automatic document feeder 100 comprises a sheet-inlet tray 101, a sheet-outlet tray 102, a pick up roller 103, a separation roller 104, a separation pad 105, a feeding channel 110, a first feeding roller module 106, a second feeding roller module 107, a scanning window 109, and an ejecting roller module 108. The first feeding roller module 106 comprises a first feeding driving roller 1061 and a first feeding idle roller 1062. The second feeding roller module 107 comprises a second feeding driving roller 1071 and a second feeding idle roller 1072. The ejecting roller module 108 comprises an ejecting drive roller 1081 and an ejecting idle roller 1082. The pick up roller 103 is disposed adjacent to the sheet-inlet tray 101, and the separation roller 104 which is adjacent to the pick up roller 103 is disposed above the separation pad 105 and contacted with it. The separation roller 104 and the separation pad 105 are arranged adjacent to the feeding channel 110. In the feeding channel 110 of the automatic document feeder 100, the documents 120 will be transported and relayed by the first feeding roller module 106, the second feeding roller module 107, and the ejecting roller module 108. In addition, a scanning window 109 is disposed between the second feeding roller module 107 and the ejecting roller module 108 for reading the image of the document 120. Besides, the sheet-outlet tray 102 is disposed adjacent to the ejecting roller module 108.

When the automatic document feeder 100 starts to operate, the stack of document 120 on the sheet-inlet tray 101 will be fed by the rotating pick up roller 103 and transported to the nip between the separation roller 104 and the separation pad 105. Because the friction between the separation roller 104 and the uppermost sheet is larger than the friction between the fed sheets or that between the lowest fed sheet and the separation pad 105, the separation pad 105 insures that only the uppermost sheet 120 contacting with the separation roller 104 will be transported into the feeding channel 110. When the sheet 120 passes through the separation roller 104 and the separation pad 105, it will be transported into the feeding channel 110, wherein, the first feeding roller module 106 driven by the first feeding driving roller 1061 is arranged to transport the sheet 120 moving on to the second feeding roller module 107. And the second feeding roller module 107 driven by the second feeding drive roller 1071 is arranged to transport the sheet 120 passing through a scanning window 109 where the image recorded on the sheet 120 could be read by a scanning device (i.e. flat scanner) which is disposed under the scanning windows 109. Finally, the sheet 120 will be ejected by the ejecting roller module 108 which is driven by the ejecting drive roller 1081, and will stay on the sheet-outlet tray 102 which is disposed adjacent to the ejecting roller module 108. In addition, the above-mentioned idle rollers are commonly-used elements and known by the person having ordinary skill in the art and no more details about that will be described in the text.

The dimension of the conventional automatic document feeder 100 is large because a plenty of components, such as the pick up roller 103, the separation roller 104, the separation pad 105, the first feeding roller module 106, the second feeding roller module 107, and the ejecting roller module 108, must be installed within the automatic documents feeder 100. Besides, the sheet transporting process of the conventional automatic document feeder 100 is unstable and the scanning quality is not good because the roller modules 106, 107 and 108 disposed in the conventional automatic document feeder 100 for transporting the document 120 are composed of the driving rollers 1061, 1071, 1081 and the idle rollers 1062, 1072, 1082 and the driving rollers and the idle rollers are interacted via point-to-point contacting. The point-to-point contacting will impact the transport quality of sheet and result in bad image quality. Furthermore, in the conventional automatic document feeder 100, the interaction between the drive roller 1061, 1071, 1081 and the idle roller 1062, 1072, 1082 are driven by gears (not shown), a rotation speed difference between the gears and the rollers 1061, 1062, 1071, 1072, 1081, 1082 will make an unstable sheet transportation and result in a dissatisfied scanning quality of the conventional automatic document feeder 100, or will even make the sheet 120 subjected to a wrinkling or tearing damage.

SUMMARY OF THE INVENTION

In view of the foregoing, it is an object of the present invention to provide an automatic document feeder, in which a conveyer belt is used for stably transporting the document.

In accordance with an aspect of the present invention, there is provided an automatic document feeder for feeding document and the automatic document feeder comprises:

a sheet inlet;

a sheet outlet;

a pick up roller module disposed adjacent to the sheet inlet for picking up and separating the document;

a driving roller module for transporting the document passing through a scanning window, the driving roller module comprises a main driving roller and a feeding roller module;

a ejecting idle roller module disposed adjacent to the sheet outlet for ejecting the document, the ejecting idle roller module comprises a first ejecting idle roller and a second ejecting idle roller;

a main belt encircling the main drive roller and the first eject idle roller; and a tension idle roller module disposed pressing to the surface of the main belt for providing tension to the main belt.

Preferably, the pick up roller module comprises a pick up belt, a pick up drive roller, and a pick up idle roller, wherein the pick up belt encircles the pick up drive roller and the pick up idle roller.

Preferably, the pick up roller module comprises a pick up driving roller and a pick up idle roller.

Preferably, feed roller module comprises an auxiliary belt and a feeding idle roller module, wherein the auxiliary belt encircles the feeding idle roller module.

Preferably, the feeding idle roller module comprises three feeding idle rollers.

Preferably, the feeding roller module comprises a feeding driving roller and a feeding idle roller.

BRIEF DESCRIPTION OF THE DRAWINGS

There are other features, aspects, and advantages of the present invention will become better understood with regard to the following description, appended claims, and accompany drawings where:

DETAILED DESCRIPTION OF THE PREFERRED EMBODIMENT

Figure 1:
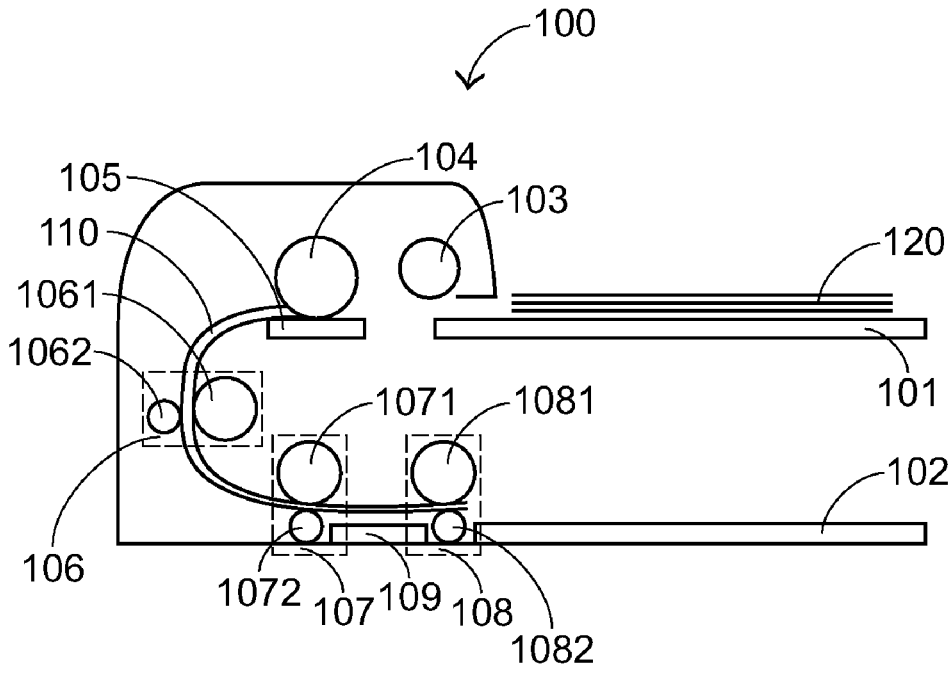
FIG.1 PRIOR ART
FIG. 1 is a schematic view showing the structure of a conventional automatic document feeder.
Figure 2:
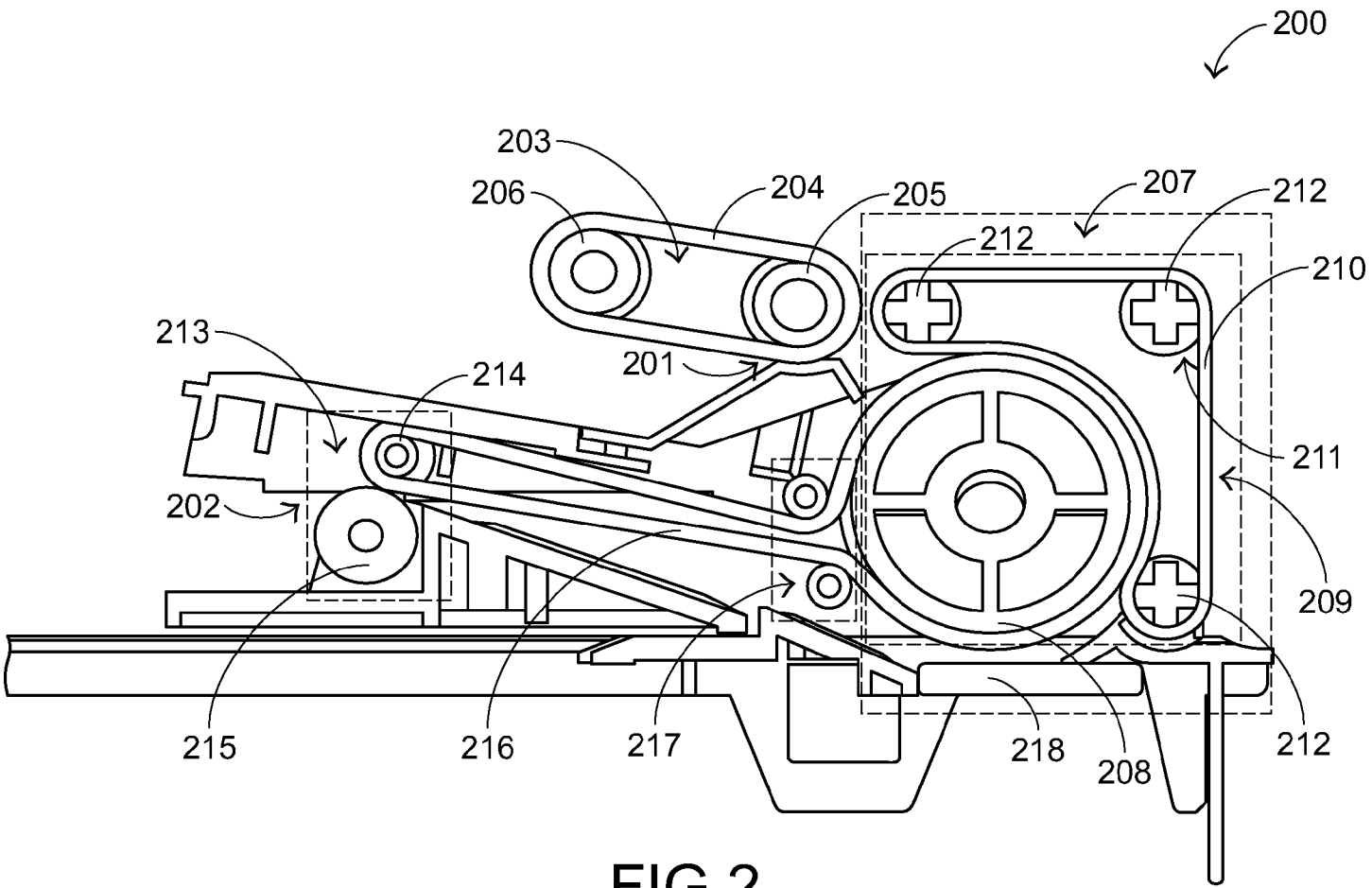
FIG. 2 is a schematic view showing the structure of an automatic document feeder provided by a preferred embodiment of the present invention.

For overcoming the above-mentioned drawbacks of the conventional automatic document feeder, the present invention provided an automatic document feeder. Referring to FIG. 2, which is a schematic view showing the structure of an automatic document feeder 200 according to a preferred embodiment of the present invention. The automatic document feeder 200 comprises a sheet inlet 201, a sheet outlet 202, a pick up roller module 203, a driving roller module 207, an ejecting idle roller module 213, a scanning window 218, a main belt 216 and a tension idle roller module 217. The pick up roller module 203 comprises a pick up belt 204, a pick up drive roller 205 and a pick up idle roller 206 and is disposed adjacent to the sheet inlet 201. The ejecting idle roller module 213 comprises a first ejecting roller 214 and a second ejecting roller 215 and is disposed adjacent to the sheet outlet 202. The driving roller module 207 comprises a main driving roller 208 and a feeding roller module 209. The feed roller module 209 comprises an auxiliary belt 210 and a feeding idle roller module 211. The feeding idle roller module 211 comprises three feeding idle rollers 212. In addition, a scanner (not shown) is arranged under the automatic document feeder 200 and the scanning module of the scanner is aligned the scanning window 218. In the driving roller module 207, the main driving roller 208 and the first ejecting roller 214 of the ejecting idle roller module 213 are encircled by the main belt 216, hence, the first eject roller 214 is driven by the main drove roller 208 through the main belt 216. In addition, the tension idle roller module 217 is against both sides of the main belt 216 for keeping the main belt 216 in tension. In addition, the auxiliary belt 210 encircles the feeding idle roller module 211 of the feeding roller module 209 and contacts the main belt 216 for assisting in transporting the document.

When the automatic document feeder 200 starts to operate, the pick up driving roller 205 rotates and simultaneously drives the pick up idle roller 206 through the pick up belt 204, and the stack of document (not shown) placed on the sheet-inlet tray (not shown) will be fed into the sheet inlet 201 of the automatic document feeder 200 by the pick up belt 204. Because the friction between the pick up belt 204 and the uppermost sheet is larger than that between any two adjacent sheets, the pick up belt 204 will feed and separate the document one by one When a sheet is transported into the automatic document feeder 200, it will be guided into the channel formed by the auxiliary belt 210 of the feeding roller module 209 and the main belt 216 and transported forward by the main belt 216 and the auxiliary belt 210 of the feeding roller module 209, wherein the feeding roller module 209 is driven by the main belt 216. The advantage of using the auxiliary belt 210 in the present invention is that since the feeding roller module 209 rotates synchronous with the main belt 216 and the driving roller module 207, when the sheet is fed in the channel, one surface of the sheet will contact the main belt 216 and the other surface of the sheet will contact the auxiliary belt 210 as well, that is, both surfaces of the sheet contact the belts, to improve the stability of sheet transportation. When the sheet left the auxiliary belt 210 the main belt 216 keeps transporting the sheet forward to the scanning window 218. The scanner (not shown) disposed under the automatic document feeder 200 will scan the image on the sheet via the scanning window 218. Finally, the sheet will be transported to the sheet outlet 202 by the main belt 216 and ejected from the automatic document feeder 200 by the first ejecting roller 214 and the second ejecting roller 215 of the ejecting idle roller module 213.

In the conventional document feeder, the sheet is transported by the driving rollers and the idle rollers via a point-to-point contacting, which will result in an unstable transporting as the description above. However, in the automatic document feeder provided by the present invention, the sheet will be stably transported by the belts with a face-to-face contacting, this is because the surface friction generated by the contacting between the belt and the sheet is larger than that between the roller and the sheet. Besides, in the automatic document feeder 200 provided by the present invention, a single belt, the main belt 216, is responsible for transporting the document from the pick up roller module 203 to the sheet outlet 202, hence, a stable and synchronous transporting will be achieved. In addition, documents are transported by belts to reduce the number of driving rollers and idle rollers and therefore the dimension of the automatic document feeder provided by the present invention is minimized.

In the above-described automatic document feeder provided by the preferred embodiment, both the pick up belt and the auxiliary belt are arranged within the pick up roller module 203 and the feed roller module 209 for picking up and feeding the document. However, in another embodiment of the present invention, the pick up belt and the auxiliary belt could be replaced with elements having equivalent functions, but the main belt will still be adapted in the automatic document feeder and take charge of the sheet transporting.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An automatic document feeder for feeding a document, said automatic document feeder comprising:

a sheet inlet;

a sheet outlet;

a pick up roller module disposed adjacent to said sheet inlet for picking up and separating the document;

a driving roller module for transporting the document passing through a scanning window and transporting the scanned document to the sheet outlet, said driving roller module comprises a main driving roller and a feeding roller module, and said feeding roller module comprises an auxiliary belt and a feeding idle roller module, and said auxiliary belt encircles said feeding idle roller module, wherein said main driving roller is disposed between said pick up roller module and said scanning window;

an ejecting idle roller module disposed adjacent to said sheet outlet for ejecting the document to said sheet outlet, said ejecting idle roller module comprises a first ejecting idle roller and a second ejecting idle roller;

a single main belt encircling said main driving roller and said first ejecting idle roller, and when a sheet is transported into the automatic document feeder, said sheet is guided into a channel formed by said auxiliary belt and said main belt; and a tension idle roller module disposed pressing to the surface of said main belt for providing tension to said main belt.

2. The automatic document feeder of claim 1, wherein said pick up roller module comprises a pick up belt, a pick up driving roller, and a pick up idle roller, and said pick up belt encircles said pick up driving roller and said pick up idle roller.

3. The automatic document feeder of claim 1, wherein said pick up roller module comprises a pick up driving roller and a pick up idle roller.

4. The automatic document feeder of claim 1, wherein said feeding idle roller module comprises three feeding idle rollers.

* * * * *